US006170791B1

(12) United States Patent
Pitcher et al.

(10) Patent No.: US 6,170,791 B1
(45) Date of Patent: Jan. 9, 2001

(54) PAPER MANAGEMENT SYSTEM

(75) Inventors: David Pitcher, Menlo Park; Don Angel, Foster City, both of CA (US)

(73) Assignee: Acco Brands, Inc., Lincolnshire, IL (US)

( * ) Notice: Under 35 U.S.C. 154(b), the term of this patent shall be extended for 0 days.

(21) Appl. No.: 09/220,982

(22) Filed: Dec. 23, 1998

(51) Int. Cl.[7] ..... A47B 19/00
(52) U.S. Cl. ..... 248/441.1; 211/41.1; 281/45
(58) Field of Search ..... 248/441.1, 442.2, 248/447, 447.2, 451, 452, 454, 455, 456, 457, 466, 462, 558, 461, 150, 126, 370, 351, 357, 450, 918; 211/41.1, 41.2, 44, 45; 281/45

(56) References Cited

U.S. PATENT DOCUMENTS

| | | | | |
|---|---|---|---|---|
| D. 167,203 | * | 7/1952 | Grode | 6/469 |
| D. 246,491 | * | 11/1977 | D'Alo | D6/467 |
| D. 300,095 | * | 3/1989 | Robinson | D6/467 |
| 500,715 | * | 7/1893 | Leslie | 248/442.2 |
| 1,060,795 | * | 5/1913 | Smith | 248/447.2 |
| 2,348,414 | * | 5/1944 | Pierce | 211/41.13 |
| 2,785,901 | * | 3/1957 | McLemore | 273/150 |
| 2,873,859 | * | 2/1959 | Gates | 211/41.1 |
| 4,125,243 | * | 11/1978 | Liptak | 248/473 |
| 4,466,593 | * | 8/1984 | Odenath | 248/455 |
| 4,501,438 | * | 2/1985 | McKee | 281/45 |
| 4,518,140 | * | 5/1985 | Ferranto | 248/456 |
| 4,531,642 | * | 7/1985 | Racich | 211/42 |
| 4,987,690 | * | 1/1991 | Aaldenberg et al. | 40/341 |
| 5,044,593 | * | 9/1991 | Jones | 248/442.2 |
| 5,289,926 | * | 3/1994 | Lewis et al. | 211/45 |
| 5,324,076 | * | 6/1994 | Nieradka | 281/45 |
| 5,464,293 | * | 11/1995 | Hall | 400/718 |
| 5,620,162 | * | 4/1997 | Beckwith et al. | 248/442.2 |
| 5,746,410 | * | 5/1998 | Hung | 248/441.1 |
| 5,897,934 | * | 4/1999 | Yeh | 281/45 |

FOREIGN PATENT DOCUMENTS

WO 97/40483 10/1997 (WO) .

* cited by examiner

*Primary Examiner*—Anita M. King
(74) *Attorney, Agent, or Firm*—McCutchen, Doyle, Brown & Enersen LLP

(57) ABSTRACT

The system includes multiple components that may be used individually, or in conjunction with other components of the system, including a copy holder, paper organizer and a monitor-mounted copy holder. The copy holder/stand accommodates a variety of paper sizes in either portrait or landscape orientation. The copy stand includes a base stand and a removable copy holder, thus allowing the copy holder to be used as a clip board. The copy holder is rotatable about the base stand, thus allowing variation of the relative angle between the user and the copy holder. The copy holder includes at least one clip, and preferably at least two different types of clips. The clips may hold papers and documents against the copy holder as well as provide a means of highlighting or marking regions of particular interest on a document page. The paper organizer may either stand-alone or be held within an opening in the base stand of the copy holder. The paper organizer includes a plurality of curved document support members, the combination of curvature and support member spacing insuring that the documents within the organizer remain in an upright position. The monitor mounted copy holder includes a clip, thus capable of holding a document to the holder. Additionally, the monitor mounted copy holder includes a cavity designed to accommodate a small notepad.

18 Claims, 5 Drawing Sheets

PAPER MANAGEMENT SYSTEM

FIELD OF THE INVENTION

The present invention relates in general to a paper management system, and in particular, to a system for holding papers of varying size in a convenient manner about a desk.

BACKGROUND OF THE INVENTION

A variety of different types of paper holders have been designed over time. Typically these holders are designed to fit a specific need of the targeted user. For example, a variety of holders have been designed to hold papers in a substantially vertical fashion near a computer or typewriter, thereby allowing the user access to the information on the papers while freeing up both hands for typing. A second variety of paper holders have been designed to hold papers in an orderly fashion on a desk. A third variety of paper holders have been designed to hold personal note cards of varying size, such as Post-it™ notes.

In the first type of paper holder, often referred to as a copy stand, a flat surface is coupled to a base unit. Typically the base unit or stand is designed to rest on a flat surface, e.g., a desk surface, while providing a means of adjusting the angle of the flat surface with respect to the user. The flat surface may include a tray along the bottom edge, thus preventing papers from sliding off of the surface. The tray can also be used to allow multiple papers to be stacked. The flat surface may include some form of clip attached to the surface, thus providing a means of clipping papers to the surface. The flat surface may also include a ruler slideably attached along one side, the ruler providing a means for the user to mark or highlight an area of interest on the paper.

In the second type of paper holder, often referred to as a paper tray, one or more trays are provided for holding papers in an orderly fashion, for example on a user's desk. Each tray is typically designed for stacking papers, thus including three sides to hold the papers in place, with a lower forward facing side. The lower side allows the user easy access to the contents of the tray. Often each tray includes a means of fixing the tray to an additional tray in a stacking fashion, thus providing the user a means of segregating different types of papers by placing the papers in different trays.

In the third type of paper holder, personal notes or notepads are held in place. For example, one type of holder designed to be placed on a desk is weighted and includes non-slip feet. Once a notepad is attached to the writing surface of the holder, for example with the use of an adhesive, a user can write a note without the pad slipping. In an alternate configuration, a notepad holder is designed to be mounted within a car, thus providing the user with an easy writing surface to jot down notes while driving or while using a mobile/cellular phone. This type of notepad holder typically uses a suction cup to mount to the inside surface of the windshield.

From the foregoing, it is apparent that what is needed is a compact, multifunctional paper holding system. The present invention provides such a system.

SUMMARY OF THE INVENTION

The present invention provides a paper management system for use in a typical office environment. The system includes multiple components that can be used individually, or in conjunction with other components of the system.

In one aspect of the invention, a copy stand is provided that is designed to accommodate a variety of paper sizes.

The copy stand includes a base stand and a copy holder. The copy holder can be removed from the base stand, thus allowing it to be used independently as a clip board. The copy holder can be attached to the base stand along either of at least two edges, allowing the copy holder to be used in either a portrait or a landscape configuration. When attached, the copy holder can be rotated about the base stand, thus allowing the relative angle between the user and the copy holder to be varied.

In another aspect of the invention, the copy holder includes at least one clip, and preferably at least two different types of clips. The clips are used to hold papers and documents against the copy holder as well as provide a means of highlighting or marking regions of particular interest on a document page. The clips can be mounted to any edge of the copy holder and, through the use of a series of guides, easily repositioned along a given edge.

In yet another aspect of the invention, a paper organizer is provided. The paper organizer is designed to fit within an opening in the base stand of the copy holder. The organizer can either be used in a stand-alone mode or while it is held within the base stand, assuming that the copy holder is not attached to the base stand and that the copy holder support is retracted (i.e., fully rotated backwards). The paper organizer includes a plurality of curved document support members, the combination of curvature and support member spacing insuring that the documents within the organizer remain in an upright position. Additionally, due to the incline of the upper surface of the organizer base, the upper edges of the documents held within the organizer are at varying heights, thus allowing the documents to be easily identified and withdrawn from the organizer.

In yet another aspect of the invention, a copy holder is provided that can be attached to either upper corner of a computer monitor. The copy holder is attached to the monitor via a combination of a mounting bracket and a support member which allows the position of the copy holder relative to the monitor to be varied. The copy holder includes a clip, thus providing a means of holding a document to the holder. Additionally, the copy holder includes a cavity designed to accommodate a small notepad.

A further understanding of the nature and advantages of the present invention may be realized by reference to the remaining portions of the specification and the drawings.

DESCRIPTION OF THE SPECIFIC EMBODIMENTS

The present invention provides a paper management system for use in a typical office environment. The system includes multiple components that can be used individually, or in conjunction with other components of the system.

Figure 1:
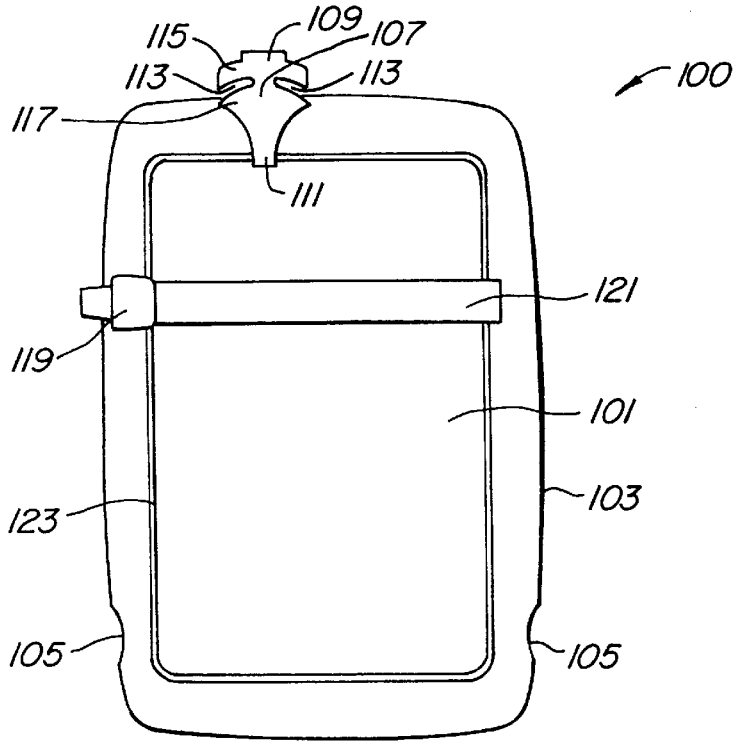
FIG. 1 is an illustration of the front surface of the flat portion of a copy stand according to present invention.

In one aspect of the invention, a copy stand is provided. The copy stand includes a base portion and a removable flat surface portion. A preferred embodiment of the front surface of a removable flat portion 100 is shown in FIG. 1. Although portion 100 can be made of a variety of materials, preferably it is fabricated from either a thermoplastic or a thermosetting plastic. The size of removable flat portion 100 is large enough to allow a variety of paper sizes to be easily accommodated, including metric sized paper (e.g., A4). Although portion 100 is designed to be coupled to a base stand portion, it may also be used as a separate clipboard. As a clipboard, portion 100 provides the user with a firm and flat surface 101 to write on. In order to provide the user with a comfortable grip, the perimeter of portion 100 preferably includes a slightly curved edge 103. Edge 103 preferably includes a pair of inwardly curved portions 105 that provide a convenient and comfortable location for carrying and holding portion 100 when it is in use as a clipboard.

Removable flat portion 100 includes one or more clips 107 that are used to hold papers against flat surface 101. Clips 107 can be attached to any of the four edges of portion 100. Each clip 107 is slideably mounted to portion 100, thus allowing the user to alter the position of the clip along the edge of portion 100 in order to accommodate papers of varying size and/or shape. To operate clip 107, the user presses along an edge portion 109 of the clip, thereby causing a portion 111 of the clip to be sufficiently elevated from flat surface 101 to permit papers to be slid between end portion 111 and flat surface 101.

Clip 107 also includes at least one slot 113, and preferably contains a pair of slots 113 located on either side of the clip. Slots 113 can be used to hold one or more pages of a document away from surface 101, thus allowing the user to see the underlying pages. For example, a user may wish to flip back and forth between two pages clipped to surface 101. To view the second page the user need only fold back the first page, slipping a portion of the first page into slot 113. The wedge shape of slot 113 keeps the page portion in place. To further enhance the holding ability of slot 113, an upper clip wing 115 can be formed at a slight angle with respect to a lower clip wing 117. In other words, clip wings 115 and 117 are preferably not formed in a single plane.

Flat portion 100 preferably also includes at least one ruler clip 119. As with clip 107, clip 119 can be slideably mounted to any of the four edges of portion 100. Furthermore, clip 119 can also be used to hold one or more document pages against surface 101. Unlike clip 107, however, clip 119 includes a ruler portion 121 that rests across at least a major portion of surface 101. Ruler portion 121 is preferably clear with graduated markings. If clip 119 is located such that ruler portion 121 extends along the long axis of surface 101 (e.g., clip 119 placed in the location of clip 107 in FIG. 1), ruler 121 can be replaced with a similar but longer ruler, thus extending the fall width of surface 101.

As shown in FIG. 1, surface 101 includes a groove 123. Groove 123 can be used in conjunction with either clips 107 or 119 to provide a better clip tracking system.

Figure 2:
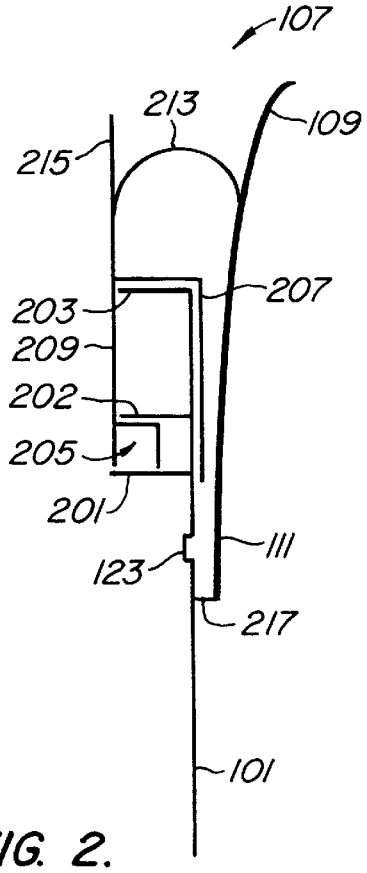
FIG. 2 is a cross-sectional view of a clip for use with the present invention.
Figure 3:
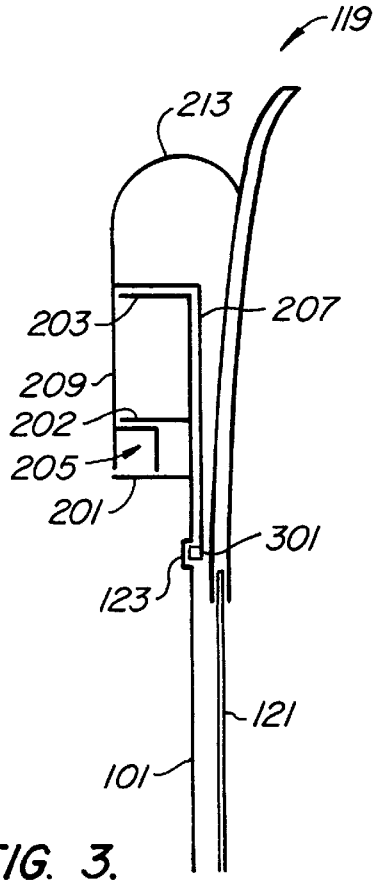
FIG. 3 is a cross-sectional view of an alternate clip embodiment.

FIGS. 2 and 3 are cross-sectional views of clips 107 and 119, respectively. As shown, flat surface 101 includes three segments 201–203 that extend from the back surface. Segments 201 and 202 create a channel into which a portion 205 of either clip 107 or clip 119 extends. Additionally, segments 201 and 202 add rigidity to flat surface 101 without adding substantial weight. Either clip also includes a portion 207 that extends over the front surface of 101 and, in conjunction with back clip portions 205 and 209, provides a means of holding the clip in place. As shown in FIG. 2, portion 207 may only extend a small distance along surface 101. Alternately, as shown in FIG. 3, portion 207 may have sufficient length to include a portion 301 that operates cooperatively with groove 123 to provide an improved clip tracking system. Segment 203 of surface 101 extends substantially between portions 207 and 209 of the clip, thereby providing additional clip stability.

Both clips 107 and 119 include a spring 213 which provides sufficient tension on the clip to hold papers between clip portion 111 and flat surface 101. Preferably spring 213 is formed simultaneously with the clip and using the same material, thus minimizing cost and labor. Other forms of spring tensioners such as those of common use in the industry can also be used. FIG. 2 illustrates one configuration of a clip in which back portion 209 extends upward, creating a surface 215 that is complimentary to clip portion 109. Thus a user can easily compress spring 213 in order to lift clip end portion 111 away from surface 101, thereby allowing one or more pages to be captured by the clip. As shown, clip end portion 111 also includes a small extension 217. Extension 217 increases the force on a very limited area of the captured document, creating an improved holding clip. FIG. 3 illustrates an alternate clip configuration in which clip back portion 209 does not extend substantially beyond spring 213. Although this configuration makes it more difficult to apply a lot of force to spring 213, it is adequate for some applications. For example, this configuration is preferred for use with ruler mounting clip 119 since the intent of this clip spring is to simply keep ruler 121 in place, not to exert a lot of pressure on the document being held onto surface 101.

Figure 4:
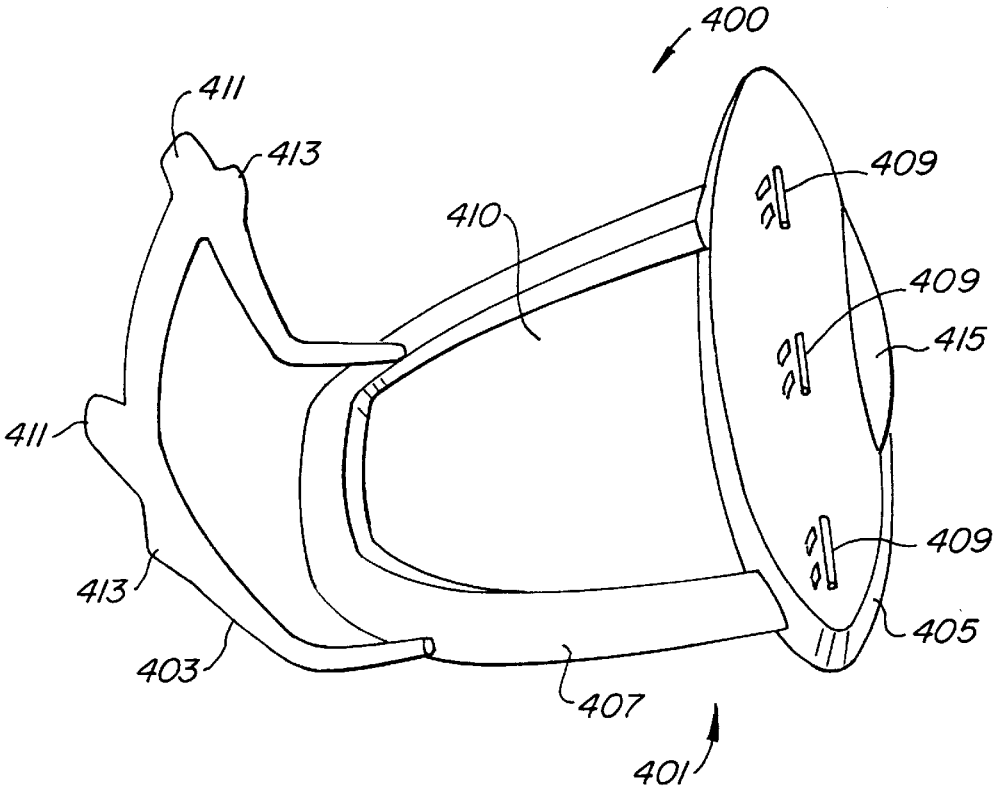
FIG. 4 is a perspective view of the copy stand base according to the present invention in which the stand support member is fully rotated backwards.
Figure 5:
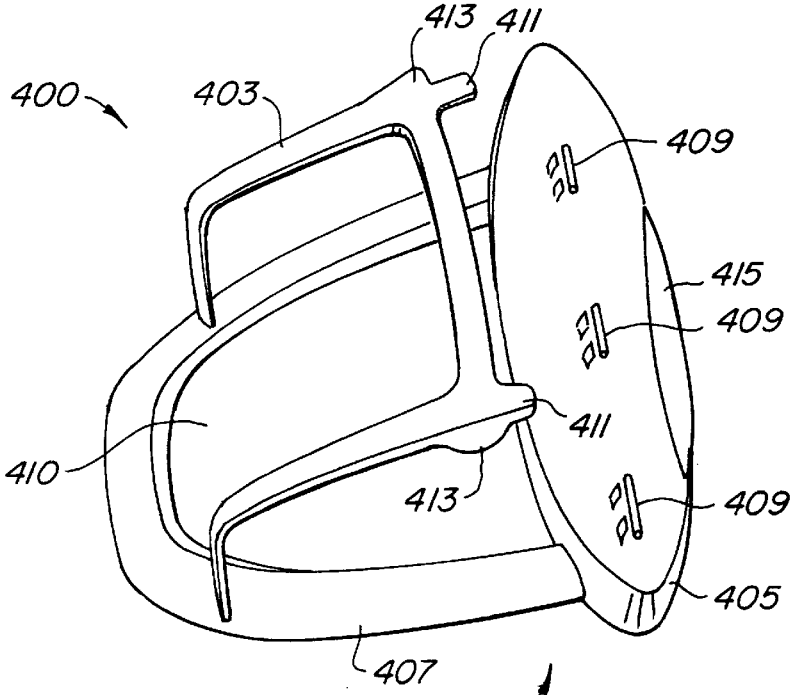
FIG. 5 is a perspective view of the copy stand base shown in FIG. 4 with the stand support member fully rotated forwards.

FIGS. 4 and 5 are perspective views of the copy stand portion 400 according to the invention. Preferably stand 400 is comprised of two members, a base member 401 and a stand support member 403, both preferably fabricated from either a thermoplastic or a thermosetting plastic. Stand support member 403 is rotatably attached to base 401, thereby allowing stand member 403 to be placed in a range of positions. Stand support member 403 is shown in two different positions in FIGS. 4 and 5. In FIG. 4 member 403 is fully rotated backwards while in FIG. 5 member 403 is shown fully rotated forwards.

Base 401 is comprised of two portions, a front portion 405 and a rear portion 407. A central region 409 is preferably left open, thus providing a storage space for another element of the present invention described fully below. Support member 403 is attached to rear portion 407. Removable flat portion 100, i.e., the copy stand, is hingeably attached to front base portion 405 through the use of at least one hinge means 409 and preferably through the use of three hinge means 409 as illustrated. When flat portion 100 is attached to base portion 400 via hinge means 409, support stand tips 411 contact a ledge on the backside of flat portion 100, thereby providing stand support. The angle of stand portion 100 relative to base portion 400 is determined by rotating support member 403, causing stand tips 411 to contact a different ledge on the backside of portion 100. Preferably a pair of side extensions 413 on support member 403 provide an easy gripping surface when the user adjusts the position of member 403.

As noted above, portion 100 preferably includes at least one clip 107 that is used to hold papers against surface 101. Alternately, when portion 100 is attached to base 400, the user can choose not to use clip 107, simply allowing the papers to rest on a ledge created by base portion 405 and an upwardly turned base lip 415.

Figure 6:
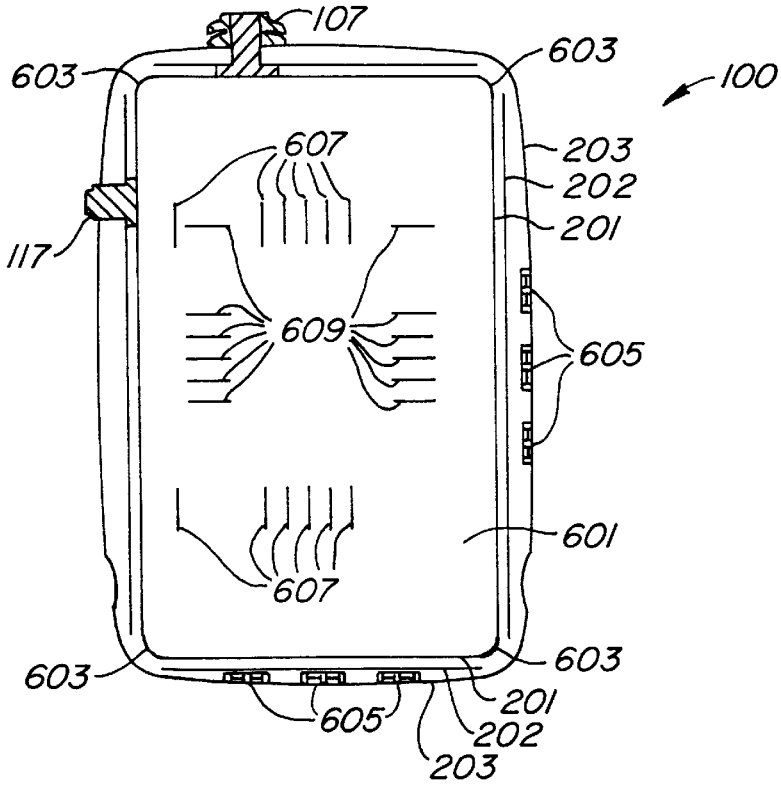
FIG. 6 is an illustration of the back surface of the flat portion of the copy stand shown in FIG. 1.

FIG. 6 is an illustration of a back surface 601 of flat portion 100. This figure shows segments or ribs 201 and 202 extending from back surface 601 as well as surface edge 203, the combination of all three providing guides for clips 107 and 119 as described above. Preferably segment 201 is a continuous segment that includes four corner segments 603. In this embodiment of the invention, the distance that corner segments 603 extend away from back surface 601 is greater than the distance that the remaining portions of segment 201 extend from surface 601. Due to the height of corner segments 603, flat portion 100 lies flat on a surface such as a desk. Furthermore, the contour of segment 201 allows portion 100 to fit comfortably on the user's lap when portion 100 is used as a stand-alone clipboard.

Portion 100 includes hinge members 605 on at least two sides, preferably along a long side and a short side of portion 100 as shown. Hinge members 605 are removably coupleable with base portion hinge members 409. Extending out from back surface 601 are two sets of ledge segments 607 and 609. Although as shown each set (i.e., 607 and 609) includes six pairs of segments, different segment spacing as well as either more or less segments can also be used. In use, when a set of hinge members 605 is coupled to base portion hinge members 409, support tips 411 intersect and provide support to a pair of ledge segments (i.e., from either set). Thus if the copy stand is used in a portrait mode a pair of segments 609 are used while if the copy stand is used in a landscape mode a pair of segments 607 are used. It should be understood that the design of the copy stand of the present invention allows it to be generally positioned between the user's monitor and the user's keyboard when it is used in the landscape mode and preferably when it is used in either the landscape mode or the portrait mode. By positioning the copy stand in this manner, the user is not required to look to either side of the monitor in order to see the document held on the stand.

Figure 7:
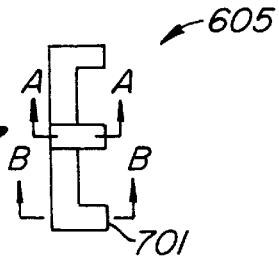
FIG. 7 is a top view illustration of a flat portion hinge member according to the invention.
Figure 8:
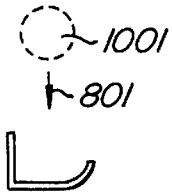
FIG. 8 is a cross-section of the hinge member shown in FIG. 7 along a plane A—A.
Figure 9:
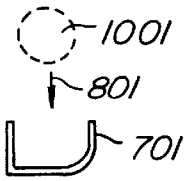
FIG. 9 is a cross-section of the hinge member shown in FIG. 7 along a plane B—B.

FIGS. 7–9 and 10–12 are detailed illustrations of hinge members 605 and 409, respectively. FIG. 7 is a top view illustration of hinge member 605. FIG. 8 is a cross-section of hinge member 605 along a plane A—A. FIG. 9 is a cross-section of hinge member 605 along a plane B—B. Both FIGS. 8 and 9 illustrate in phantom a rod-like portion 1001 of hinge member 409. As shown, rod-like portion 1001 is moving in a direction 801, thus indicating that hinge members 409 and 605 are in the process of being coupled.

Figure 10:
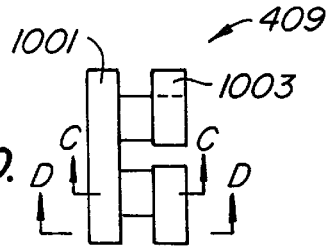
FIG. 10 is a top view illustration of a base portion hinge member according to the invention.
Figure 11:
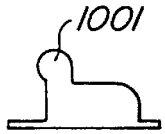
FIG. 11 is a cross-section of the hinge member shown in FIG. 10 along a plane C—C.
Figure 12:
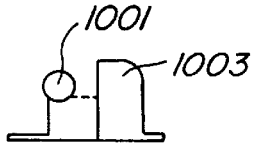
FIG. 12 is a cross-section of the hinge member shown in FIG. 10 along a plane D—D.

FIG. 10 is a top view illustration of hinge member 409. FIG. 11 is a cross-section of hinge member 409 along a plane C—C. FIG. 12 is a cross-section of hinge member 409 along a plane D—D. During hinge member coupling, the members must be brought together in a direction 801. Once the hinge members are coupled, a pair of shoulders 1003 of member 409 coincide with a pair of shoulders 701 of member 609. As the two hinge members are rotated with respect to one another, for example during copy stand angle adjustment, shoulder members 701 and 1003 prevent flat portion 100 from accidentally separating from base portion 400.

Figure 13:
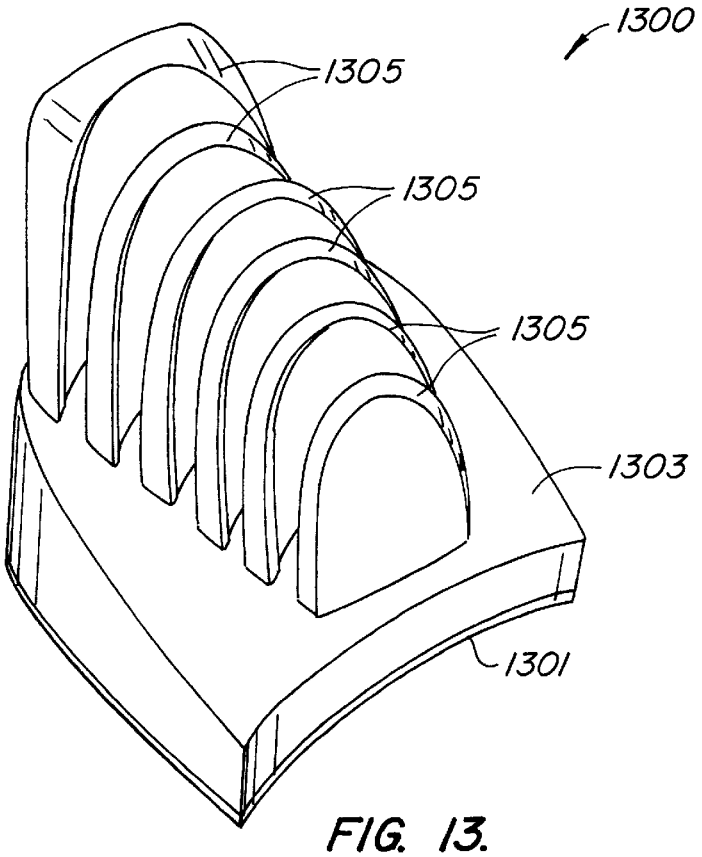
FIG. 13 is a perspective view of a paper organizer according to the invention.
Figure 14:
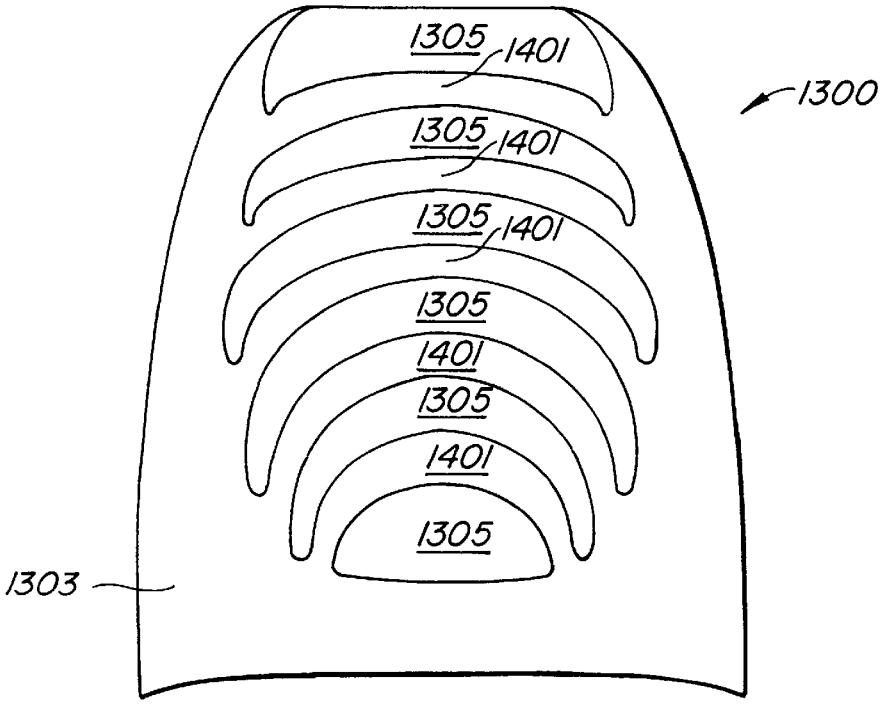
FIG. 14 is a top illustration of the paper organizer shown in FIG. 13.

FIGS. 13 and 14 provide a perspective view and a top view, respectively, of a paper organizer 1300 according to the invention. Preferably paper organizer 1300 is fabricated from a single piece of either a thermoplastic or a thermosetting plastic. Alternately, organizer 1300 can be fabricated from other materials and/or utilize a multi-component design. For example, organizer 1300 can include a base structure 1301, such as a non-slip rubber base, thereby preventing organizer 1300 from slipping around the user's desk.

Organizer 1300 is comprised of a base 1303 and a plurality of curved support members 1305. The footprint of base 1303 preferably matches central region 410 in copy stand base 400, thereby allowing organizer 1300 to fit within copy stand base 400. Due to the complementary size of these two components, during storage or non-use organizer 1300 can be placed within base 400, thus minimizing the amount of lost desk space. Additionally, organizer 1300 can be used while it is in this location, provided that flat portion 100 is not coupled to base 400 and that support structure 403 is rotated backwards into a position such as that shown in FIG. 4.

As shown, organizer 1300 includes six document support members 1305. It is to be understood that organizer 1300 can include either fewer or greater numbers of support members. Documents, either single page documents or multiple page documents, fit within spacing 1401 between support members 1305. Due to the relatively narrow spacing between members 1305 as well as the slight curvature of the members, documents placed between the members remain in an upright position. Additionally, since the top surface of organizer base 1303 is sloped, the top edges of the documents held within successive pairs of members 1305 are at varying heights (i.e., staggered) with documents of the lowest height being closest to the front edge of organizer 1300. Thus a user is able to not only identify which member pairs hold a document, but also easily withdraw a document from the organizer.

Figures 15, 16, 17:
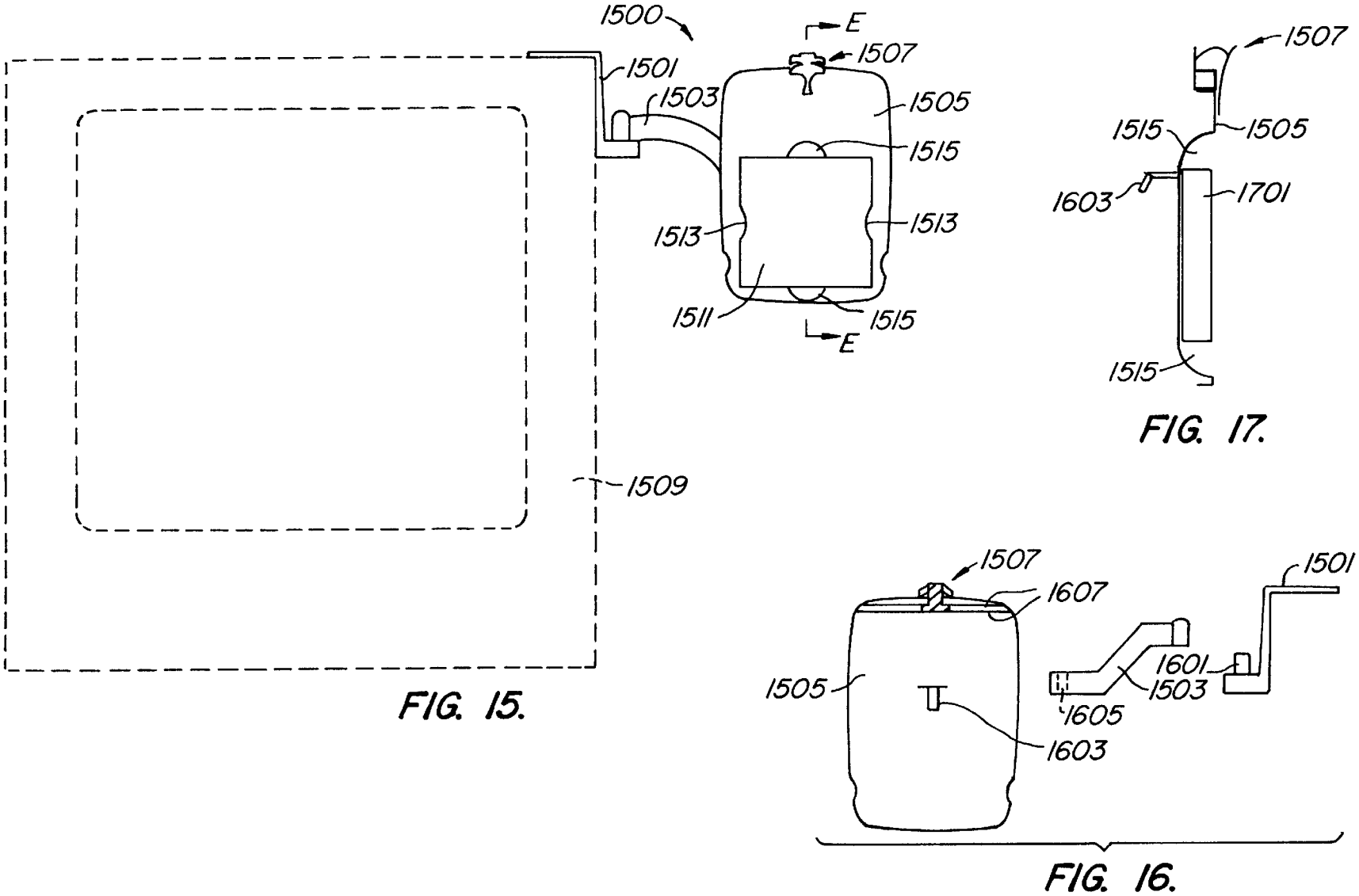
FIG. 15 is an illustration of a copy stand mounted to a computer monitor in accordance with the present invention.
FIG. 16 is an exploded reverse view of the copy stand shown in FIG. 15.
FIG. 17 is a cross-section of the copy holder shown in FIG. 15 along a plane E—E.

FIGS. 15 through 17 illustrate a copy stand 1500 according to another aspect of the invention. Copy stand 1500 is preferably comprised of four components; a mounting bracket 1501, a support member 1503, a copy holder 1505, and a copy clip 1507. Although each component of copy stand 1500 can be made from a variety of materials, preferably each component is fabricated from either a thermoplastic or a thermosetting plastic. Mounting bracket 1501 is used to attach copy stand 1500 to a location raised off of the desk surface. Preferably mounting bracket 1501 is attached to either the upper right (as shown) or upper left corner of a computer monitor 1509, shown in phantom in FIG. 15. Bracket 1501 can be mounted via hook and loop material, adhesives, or other means to monitor 1509.

FIG. 16 is an exploded reverse view of copy stand 1500. As shown, support member 1503 is rotatably attached to both bracket 1501 and copy holder 1505, thus allowing the position of the copy holder to be varied. Variable position allows the user to place the copy holder in an optimum viewing position during use and swing the copy holder away during non-use. In order to achieve rotatability, support member 1503 fits over a mounting bracket spindle 1601. Similarly, a spindle 1603 on the back surface of copy holder 1505 fits within a hole 1605 in support member 1503.

Clip 1507 is similar to clip 107 illustrated in FIGS. 1 and 6 and is used to hold papers to copy holder 1505. Preferably clips 1507 and 107 are identical and interchangeable. As with clip 107, a pair of ledges 1607 extending from the back surface of copy holder 1505 provide a guide to clip 1507 and prevent clip 1507 from unintentionally dropping off.

Included within copy holder 1505 is a cavity 1511. The size of cavity 1511 is selected to accommodate a specific size personal notepad (e.g., Post-it™ notes). Preferably the size of cavity 1511 is selected to accommodate 3 inch by 3 inch notepads. A pair of extensions 1513 extending from either side of cavity 1511 insures that a notepad 1701, shown in phantom in FIG. 17, is held in place within the cavity. A pair of depressions 1515 at the top and the bottom of cavity 1511 is designed to accommodate a user's fingers, providing easy access to notepad 1701.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. A paper management system, comprising:

a base stand, wherein said base stand includes a first hinge portion;

a support bracket rotatably attached to said base stand, wherein said support bracket includes a bracket tip;

a copy stand, wherein said copy stand includes a second hinge portion along a first edge and a third hinge portion along a second edge, wherein said first hinge portion and said second hinge portion are removably coupleable and wherein said first hinge portion and said third hinge portion are removably coupleable, wherein a back surface of said copy stand includes a plurality of planar surface protrusions extending from said back surface, wherein at least one of said plurality of planar surface protrusions is aligned with said bracket tip when said first hinge portion and said second hinge portion are coupled, and wherein at least one of said plurality of planar surface protrusions is aligned with said bracket tip when said first hinge portion and said third hinge portion are coupled; and a first clip removably coupleable to said copy stand.

2. The paper management system of claim 1, wherein said base stand includes three first hinge portions, and wherein said copy stand includes three second hinge portions along said first edge and three third hinge portions along said second edge.

3. The paper management system of claim 1, wherein said support bracket includes two bracket tips.

4. The paper management system of claim 1, wherein said first hinge portion and said second hinge portion are only coupleable when said first hinge portion and said second hinge portion are aligned substantially along a first plane, and wherein said first hinge portion and said third hinge portion are only coupleable when said first hinge portion and said third hinge portion are aligned substantially along said first plane.

5. The paper management system of claim 1, wherein an edge of said back of said copy stand includes a channel defined between a set of guide rails and wherein a back portion of said first clip is interposed between said set of guide rails.

6. The paper management system of claim 1, said first clip further comprising a front clip portion coupled to a back clip portion, wherein said front clip portion includes at least one slot, said slot capable of holding a document page folded away from a front surface of said copy stand.

7. The paper management system of claim 1, further comprising a second clip removably coupleable to said copy stand, wherein said second clip includes an elongated portion extending substantially across said copy stand.

8. The paper management system of claim 7, wherein said elongated portion includes graduated markings.

9. The paper management system of claim 1, wherein said back surface of said copy stand includes a plurality of elevated portions, said elevated portions extending away from said back surface further than any other back surface feature providing a level plane on which said copy stand can rest.

10. The paper management system of claim 1, said back surface of said copy stand further comprising a continuous planar member extending away from said back surface around a periphery of said back surface, said continuous planar member adding rigidity to said copy stand.

11. The paper management system of claim 10, wherein said continuous planar member is contoured to extend variable distances from said back surface at various points around said periphery.

12. The paper management system of claim 11, wherein said planar member includes a corner corresponding to each corner of said copy stand and wherein each corner of said contoured continuous planar member extends outwardly from said back surface sufficiently to provide a level resting plane when said back surface of said copy stand is disposed on a leveled surface.

13. The paper management system of claim 1, further comprising a paper holder, wherein said paper holder includes a housing having a base portion and said housing having a top surface defining a plurality of document separators, wherein said base portion fits within an opening in said base stand, and wherein adjacent surfaces of said plurality of document separators are cooperatively curved.

14. The paper management system of claim 13, wherein a document interposed between a pair of said adjacent surfaces is held upright due to a spacing between said pair of adjacent surfaces and said curvature of said adjacent surfaces.

15. The paper management system of claim 13, wherein said base portion of said paper holder is inclined.

16. The paper management system of claim 13, wherein said plurality of document separators includes at least six document separators.

17. A paper management system, comprising:

an attachment bracket;

a support bracket rotatably attached to said attachment bracket;

a copy stand rotatably attached to said support bracket, wherein a front surface of said copy stand includes a cavity of suitable size to fit a notepad; and a clip removably coupleable to said copy stand, said clip further comprising a front clip portion coupled to a back clip portion, wherein said front clip portion includes at least one slot, said slot capable of holding a document page folded away from the front surface of said copy stand.

18. A paper management system, comprising:

an attachment bracket;

a support bracket rotatably attached to said attachment bracket;

a copy stand rotatably attached to said support bracket, wherein a front surface of said copy stand includes a cavity of suitable size to fit a notepad; and a clip removably coupleable to said copy stand, wherein said front surface of said copy stand further comprises a pair of depressions extending into said cavity from opposing cavity sides.

* * * * *